US007927154B2

(12) United States Patent
Sekela et al.

(10) Patent No.: US 7,927,154 B2
(45) Date of Patent: Apr. 19, 2011

(54) BI-PIN CONNECTOR AND A LAMP EMPLOYING THE SAME

(75) Inventors: William David Sekela, Aurora, OH (US); Mathew Sommers, Sagamore Hills, OH (US); Alan B. Toot, Warren, OH (US); Gerald P. O'Hara, Jr., Valley View, OH (US); Todd E. Cassidy, Medina, OH (US); Peter J. Totarella, Mentor, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 187 days.

(21) Appl. No.: 12/119,182

(22) Filed: May 12, 2008

(65) Prior Publication Data

US 2009/0280695 A1 Nov. 12, 2009

(51) Int. Cl.
*H01R 24/00* (2006.01)

(52) U.S. Cl. ..... 439/699.2; 362/217.13; 362/651; 362/655; 439/332; 439/340

(58) Field of Classification Search ..... 362/172, 362/651, 649, 657, 655, 378, 249.1, 238, 362/249.01, 217.12, 699.2, 217.13; 439/699.2, 439/240, 336, 616, 617, 334, 335, 10, 171, 439/534, 173

See application file for complete search history.

(56) References Cited

U.S. PATENT DOCUMENTS

| | | | | |
|---|---|---|---|---|
| 3,723,945 | A * | 3/1973 | Detch | 439/233 |
| 3,752,977 | A * | 8/1973 | Davis | 362/216 |
| 6,861,658 | B2 | 3/2005 | Fiset | |
| 6,997,576 | B1 | 2/2006 | Lodhie et al. | |
| 7,052,171 | B1 * | 5/2006 | Lefebvre et al. | 362/649 |
| 7,097,327 | B1 * | 8/2006 | Barton | 362/260 |
| 7,153,151 | B2 * | 12/2006 | Lingemann et al. | 439/239 |
| 7,556,396 | B2 * | 7/2009 | Kuo et al. | 362/217.01 |
| 2007/0059989 | A1 | 3/2007 | Kura et al. | |
| 2009/0091929 | A1 * | 4/2009 | Faubion | 362/234 |
| 2009/0159919 | A1 * | 6/2009 | Simon et al. | 257/99 |
| 2009/0244911 | A1 * | 10/2009 | Schapira et al. | 362/382 |

FOREIGN PATENT DOCUMENTS

| | | |
|---|---|---|
| JP | 05-114304 | 5/1993 |
| KR | 10-2006-0109425 | 10/2006 |

OTHER PUBLICATIONS

PCT/US2009/043562 Search Report.

* cited by examiner

*Primary Examiner* — Evan Dzierzynski
(74) *Attorney, Agent, or Firm* — Fay Sharpe LLP

(57) ABSTRACT

A bi-pin connector for a luminaire includes a base and pins that can rotate relative to the base. The pins can also translate relative to a light fixture housing in a direction transverse to the axis about which the pins rotate. A luminaire including the bi-pin connector is also disclosed.

20 Claims, 5 Drawing Sheets

BI-PIN CONNECTOR AND A LAMP EMPLOYING THE SAME

BACKGROUND

Fluorescent lights typically include a glass tube capped at each end by end caps. Pins extend from the end caps to provide what is known in the art as a bi-pin connector. To install these fluorescent lights, the pins are inserted into an electrical connector known as a tombstone. The tube is then rotated to provide an electrical and mechanical connection between the fluorescent tube and the tombstone.

Lamps that employ light emitting diodes (LEDs) have been used to replace fluorescent lights. LEDs can be considered directional point light sources when compared to a fluorescent tube, which illuminates light 360 degrees around the longitudinal axis of the tube. Known LED lamps that have been used to replace or retrofit fluorescent lights employ a translucent tubular sheath that surrounds the LEDs. The tubular sheath is similar to the glass tube of a fluorescent lamp. Bi-pin connectors connect fast to the sheath to cap each end of the sheath.

To connect this LED lamp to a conventional fluorescent fixture, the bi-pin connectors are inserted into respective tombstones and the tubular sheath is rotated, which results in rotation of the bi-pin connector. Rotation of the tubular sheath results in rotation of the LEDs. This can cause problems since, as mentioned above, LEDs can be considered directional point light sources when compared to a fluorescent tube. Where the LED lamp that is to replace a fluorescent light is not cylindrical or the tombstones are located in a tight location, requiring the tubular sheath, or non-cylindrical housing, to rotate can be undesirable. Additionally, known bi-pin connectors do not provide for further adjustment of the lamp.

SUMMARY

A lighting fixture that can connect with a tombstone typically used with a fluorescent tube includes a fixture housing, a light source disposed in the housing, and a bi-pin connector attached to the housing and electrically connected to the light source. The bi-pin connector includes pins that rotate relative to the housing about a rotational axis interposed between the pins.

The lighting fixture can include a biasing element to urge the pins away from the fixture housing in a direction parallel to the rotational axis. The pins can also be movable relative to the housing in a direction transverse to the rotational axis. Additionally, the lighting fixture can further include an additional bi-pin connector attached to the housing that includes pins that rotate relative to the housing. This additional bi-pin connector need not be electrically connected to the light source. Instead, this bi-pin connector can simply provide a mechanical connection for the light fixture to a conventional tombstone.

A bi-pin connector for a luminaire that provides more flexibility with regard to the orientation of the luminaire includes a base configured for attachment to an associated luminaire housing and pins that rotate relative to the base about a rotational axis spaced from each pin. The bi-pin connector can include a connector body that includes flats or a slot for engagement with a tool to facilitate rotating the bi-pin connector body relative to the base.

According to an alternative embodiment, a luminaire can include a luminaire housing, a light source disposed in the housing, a first bi-pin connector attached to the housing and electrically connected to the light source, and a second bi-pin connector attached to the housing and electrically isolated from the light source. Each of the bi-pin connectors can include pins that rotate relative to the housing about a rotational axis interposed between the pins. Each of the bi-pin connectors can also include pins that translate relative to the housing.

In yet another alternative embodiment, a light fixture can include a fixture housing, a light source disposed in the fixture housing, and a bi-pin connector attached to the housing and electrically connected to the light source. The bi-pin connector can include pins that extend in a first direction that is parallel to an axis and the pins can translate in a direction perpendicular to the axis relative to the housing.

BRIEF DESCRIPTION OF THE DRAWINGS

FIG. 5 shows the bi-pin connector in an unlocked configuration. FIG. 6 shows the bi-pin connector in a locked configuration.

DETAILED DESCRIPTION

Figure 1:
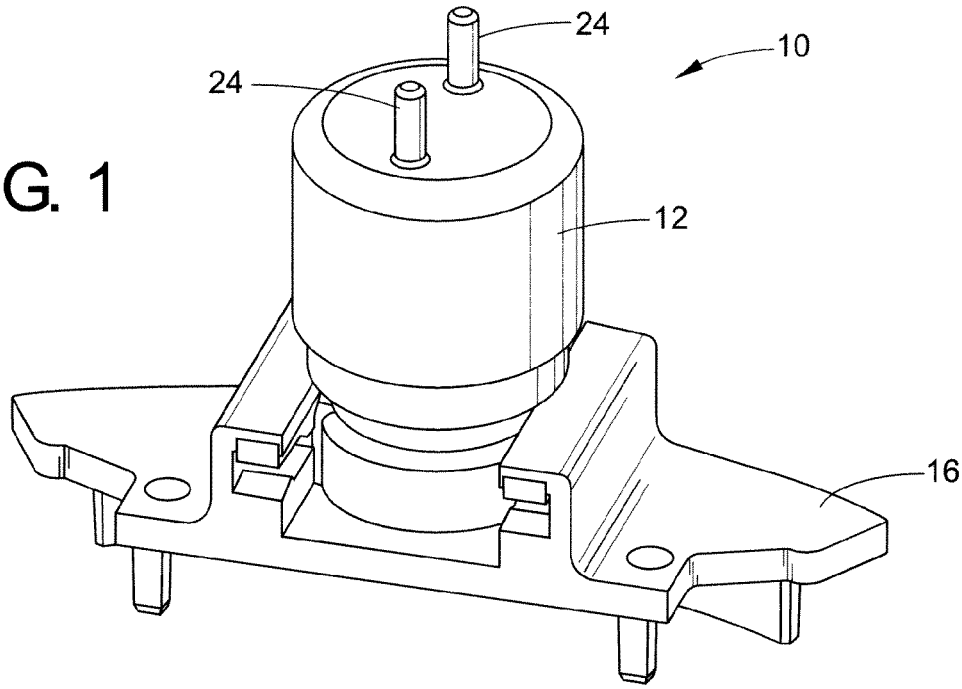
FIG. 1 is a perspective view of a bi-pin connector connected to a light fixture housing (only a portion of the fixture housing is shown).
Figure 2:
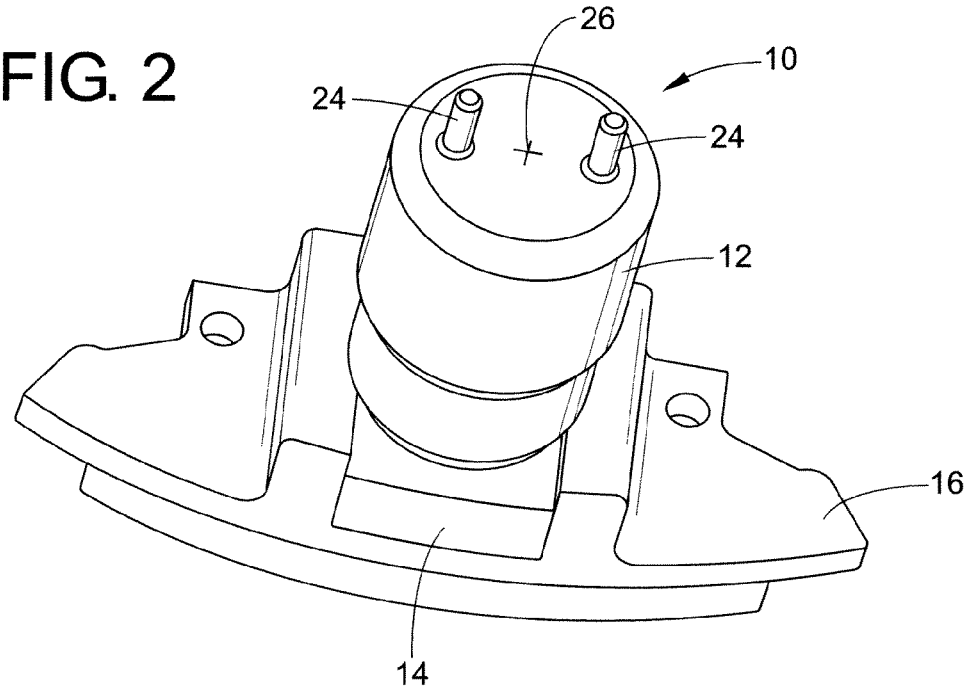
FIG. 2 is another perspective view, from an opposite side as that shown in FIG. 1, of the bi-pin connector attached to the light fixture housing.
Figure 3:
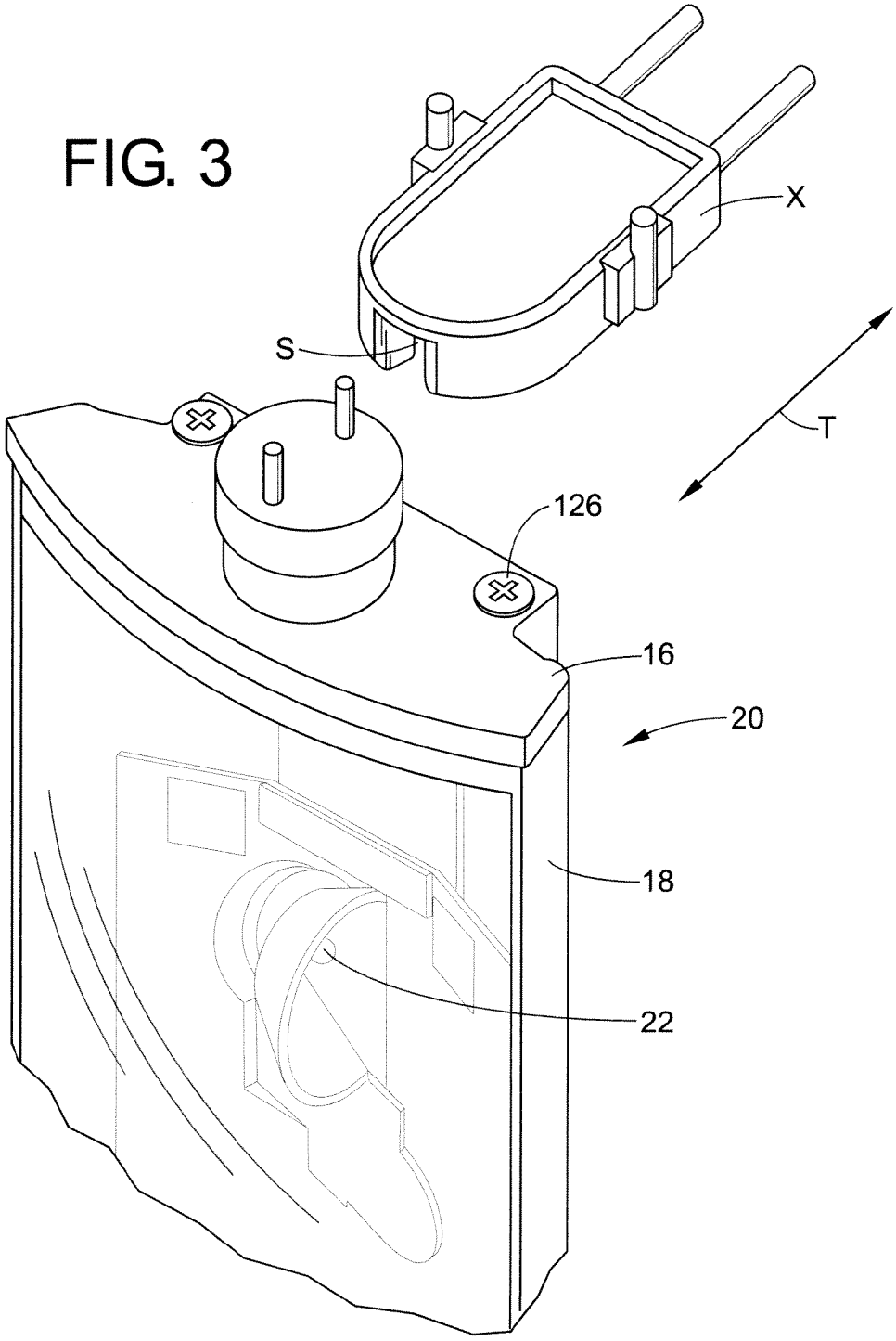
FIG. 3 is another perspective view showing a light fixture including the bi-pin connector and a conventional tombstone to which the bi-pin connector mechanically connects.

With reference to FIGS. 1 and 2, a bi-pin connector 10 generally includes a bi-pin connector body 12 that attaches to a base 14. Both the connector body 12 and the base 14 are shown connected to an end cap 16, which comprises a portion of a light fixture housing or a luminaire housing 18 (FIG. 3) of a luminaire 20 (also referred to as a light fixture). With reference to FIG. 3, a light source 22 is disposed in the fixture housing 18. In the embodiment depicted in FIG. 3, the light source is a plurality of LEDs 22 inside the fixture housing 18 each facing in the same direction. Since LEDs can be considered discreet point light sources that illuminate light toward a general direction, as compared to a fluorescent tube lamp which generates light 360 degrees about the longitudinal axis of the tube, it is often desirable to point the LEDs in a desired direction to direct the light emanating from the luminaire toward a target plane. For example, LED light fixtures have been used to illuminate the contents of a commercial refrigerated display case. The target plane that is to be illuminated in this instance is the vertical plane that intersects the front edge of the shelves of the refrigerated display case. The target plane could also be the floor of a building or the ground where the light fixture is used for a down lighting application. In these instances, it is desirable to direct the light from the LEDs 22 towards the target plane while maintaining a certain orientation of the light fixture housing 18 with respect to another structure, such as the mullion of a commercial refrigeration display case or the ceiling of building in the down lighting application. The luminaire 20 can include optics, reflectors, lenses and other components to direct the light toward a desired location.

With reference back to FIGS. 1 and 2, the bi-pin connector 10 attaches to the fixture housing and electrically connects to the light source, which can be the LEDs 22 shown in FIG. 3 or another type of light source, such as a fluorescent light source, an incandescent light source, an arc-type lamp, laser diodes, and the like. The bi-pin connector 10 includes pins 24 that rotate relative to the end cap 16 (and thus the fixture housing 18 in FIG. 3) about a rotational axis 26 that is interposed between the pins.

Figure 4:
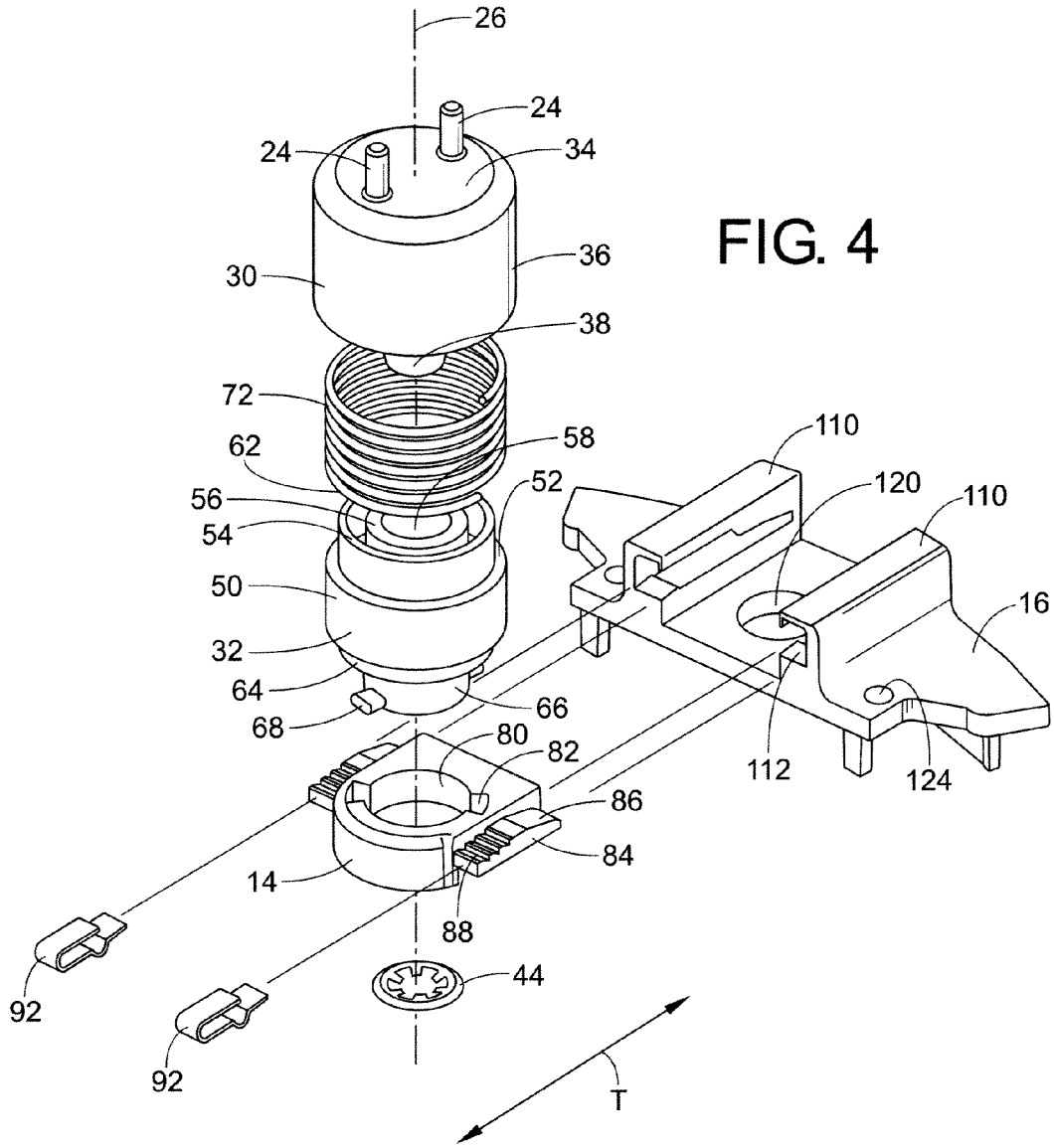
FIG. 4 is an exploded view of the bi-pin connector shown in FIG. 1.

With reference to FIG. 4, the bi-pin connector body 12 shown in the depicted embodiment includes a cap 30 and a collar 32. The bi-pin cap 30 includes a circular upper end wall 34. The center of the circular upper end wall 34 is concentric with the rotational axis 26 about which the pins 24 rotate. The cap 30 is made from an electrically non-conductive material, preferably plastic, to electrically isolate the pins 24 from one another. In the embodiment shown in FIG. 4, a cylindrical outer wall 36 depends downwardly from the circular upper end wall 34. If desired, the cylindrical outer wall 36 can include flats so that a wrench can engage the outer wall, or a slot to receive a screw driver to facilitate rotating the bi-pin cap 30, and thus the bi-pin connector body 12, with respect to the base 14. Accordingly, the cap 30 can take other configurations, e.g., polygonal in a cross section taken normal to the rotational axis 26.

A cylindrical keyed stem 38 depends downwardly from the circular upper end wall 34 and is concentric with the rotational axis 26. The cylindrical keyed stem 38 is spaced radially from the cylindrical outer wall 36. The cylindrical keyed stem 38 depends downwardly below a lower edge of the cylindrical outer wall 36. As more clearly seen in FIGS. 5 and 6, an axially aligned notch 42 is formed in the cylindrical keyed stem 38. This notch cooperates with the collar 32 in a manner that will be described in more detail below to provide a keyed connection between the cap 30 and the collar 32. A snap ring 44 connects to the cylindrical keyed stem 38 to attach the bi-pin cap 30 to the collar 32 to limit translational movement of the cap 30 relative to the collar 32 in the rotational axis 26.

As mentioned above, the connector body 12 also includes the collar 32. The collar includes a central outer cylindrical wall 50 that is dimensioned to be received between the cylindrical outer wall 36 and the cylindrical keyed stem 38 of the bi-pin cap 30. The collar 32 is also made from an electrically non-conductive material, for example plastic. The central outer cylindrical wall 50 terminates at an upper end at an annular shoulder 52. An upper outer cylindrical wall 54 extends upwardly from the shoulder 52 towards the bi-pin cap 30. A cylindrical boss 56 is disposed inside of and is concentric with the upper outer cylindrical wall 54. The boss 56 includes an opening 58 that extends entirely through the collar 50. An axially aligned key 62 extends into the opening 58 from the boss 56. The key 62 cooperates with the notch 42 (FIG. 5) formed in the cylindrical keyed stem 38 of the bi-pin cap 30 to fix the rotational movement of the bi-pin cap relative to the collar 32. In other words, with the key 62 received in the notch 42, the bi-pin cap 30 rotates along with the collar 32.

The collar 32 also includes a lower tapered section 64 that depends downwardly from the central outer cylindrical wall 50 and leads to a lower cylindrical section 66. Radial ears 68 extend radially outwardly from a peripheral surface of the lower cylindrical section 66. The collar 32 can take other configurations, especially when the cap 30 has an alternative configuration.

A biasing element, which in the depicted embodiment is a spring 72, biases the pins 24 away from the fixture housing 18 (FIG. 3). In the depicted embodiment, the spring 72 is seated on the shoulder 52 and surrounds the upper outer cylindrical wall 54 to bias the bi-pin cap 30 away from the collar 32. The spring 72 is received between the cylindrical outer wall 36 and the cylindrical keyed stem 38 of the bi-pin cap 30. The cylindrical keyed stem 38 is received through the bore 58 in the collar 32 and the snap ring 44 retains the bi-pin cap 30 to limit the travel of the bi-pin cap relative to the collar 32 and relative to the base 14 and thus relative to the end cap 16 and the fixture housing 18 (FIG. 3). The spring 72 can take up any slack that may result from the lighting fixture deforming the mounting brackets for the tombstones into which a new lighting fixture that includes the bi-pin connectors 10 will be mounted. For example, in a refrigerated display case that has been illuminated by fluorescent tubes, an LED light assembly that includes the bi-pin connector 10 will typically be heavier than the fluorescent tube that it will replace. The additional weight to the brackets to which the tombstones are attached may result in the brackets bending. The spring 72 urges the pins 24 toward the tombstones (or only one of the tombstones) to take up the slack due to deformation of the bracket.

Moreover, the light fixture that includes one bi-pin connector at each end of the fixture, may only electrically connect one of the bi-pin connectors to the light source inside the fixture leaving the other bi-pin connector electrically isolated from the light source. Typically, the electrically isolated bi-pin connector will include a spring while the other connector, which is in electrical communication with the light source, will typically not include the spring.

With reference to FIG. 4, the bi-pin connector body 12, which in the depicted embodiment comprises the bi-pin cap 30 and the collar 32 but could be made as one piece or unit, connects to and is rotatable relative to the base 14. The base 14 includes a circular opening 80 that is concentric with the rotational axis 26 and includes keyed sections 82 that are offset 180 degrees from one another. The opening 80 receives the lower cylindrical section 66 of the collar 32 and the keyed sections 82 receive the radial ears 68. The body 12 is rotated to connect to the base 14.

The base 14 includes extensions 84 on opposite sides of the base 14. Each extension 84 extends transverse to the rotational axis 26. Each extension 84 includes a leading ramp 86 and a plurality of detents 88 disposed rearwardly from the ramp. The extensions 84, and more specifically the detents 88, cooperate with spring clips 92 and the end cap 16 in a manner that will be described in more detail below. As mentioned above, the body 12 is rotated to connect to the base 14.

Figure 5:
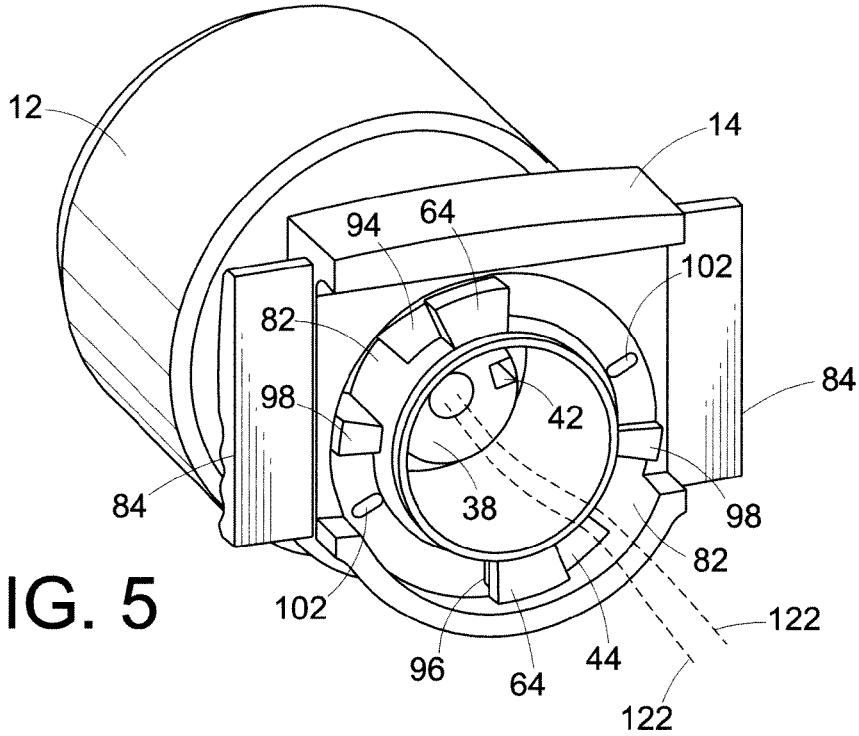
FIGS. 5 and 6 are lower perspective views of the bi-pin connector.
Figure 6:
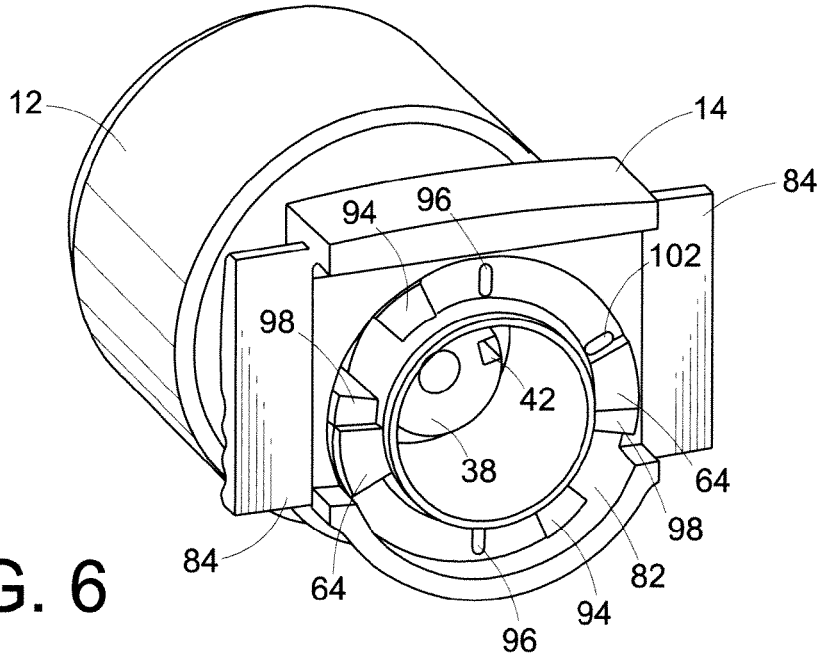

As more clearly seen in FIGS. 5 and 6, ramps 94 are formed on a lower surface of the base 14 adjacent the keyed sections 82 of the opening 80. Small bumps 96 are spaced from each ramp 94 traveling along the circumference of the opening 80. The distance between the rear edge of the ramp 94 and the adjacent edge of the bump 96 is such that the ears 64 are received between the ramp 94 and the bump 96 to lock the pins 24 (FIGS. 1 and 2) in an unlocked position, which is shown in FIGS. 1 and 5. Stops 98 are spaced approximately 90 degrees from a rearward edge of each ramp 94. A small bump 102, similar to the small bump 96, precedes each stop 98. The small bump 102 is spaced from the stop 98 to receive the ears 64 in the locked position (see FIGS. 2 and 6).

Figure 7:
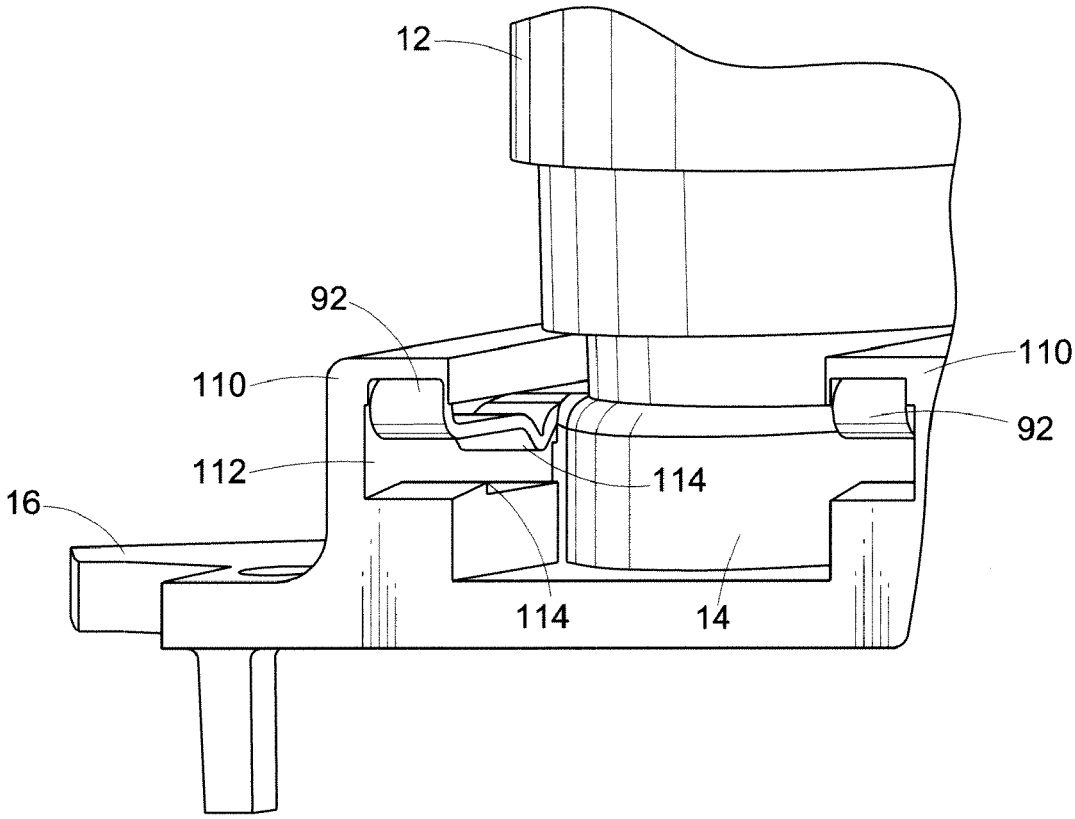
FIG. 7 is a close-up perspective view showing the connection between the light fixture housing and the bi-pin connector.

The end cap 16 typically attaches to the fixture housing 18. Accordingly, the end cap can also be considered a part of the fixture housing. With reference back to FIG. 4, the end cap 16 includes connection structures 110 for connecting the base 14 to the end cap 16. The connection structures 110 each include a notch 112 each configured to receive a respective spring clip 92 and a respective extension 84 of the base 14. The connection between the base 14 and the end cap 16 allows for adjustment of the base with respect to the end cap 16 (and fixture housing 18) in an axis T transverse to the rotational axis 26 of the bi-pin connector 10. With reference to FIG. 7, each transverse slot 112 formed in a corresponding mounting structure 110 includes a step 114. With the spring clip 92 and the extension 84 received in a respective transverse slot 112, the step 114 limits rearward translational movement of the bi-pin connector 10 with respect to the end cap 16. The spring clip 92 is inserted into the transverse slot 112 and includes a bent protuberance 116 that cooperates with the detents 88 (FIG. 4) formed in each extension 84 of the base 14. The protuberance 116 is received in a respective detent 88 to control translational movement of the base 14 with respect to the end cap 16 in the axis T that is transverse to and more particularly perpendicular to, the rotational axis 26. This type of connection between the base 14 and the end cap 16 allows for the translational movement of the pins 24. This is useful, for example, to properly locate the fixture housing 18 with respect to a tombstone t (FIG. 3) that can be found in a commercial refrigeration display case. For example, where the fixture housing 18 abuts against a mullion of a refrigerated display case, but the bi-pin connector does not properly align with the tombstone t along the axis T, the bi-pins can translate in this axis so that they can be inserted into the tombstone t.

With reference back to FIG. 4, the end cap 16 also includes an opening 120 formed through the end cap 16 in between the mounting structures 110. Wires 122 (depicted schematically in FIG. 5) extend through the opening 120 to provide for the electrical connection between the pins 24 and the light source 22 (FIG. 3). The end cap 16 also includes fastener openings 124 that receive fasteners 126 (FIG. 3) for attaching the end cap 16 to the fixture housing 18. Seals, or gaskets, can be interposed between an external surface of the end cap 16 and a lower surface of the base 14 to prevent moisture from entering into the housing 18 of the lighting fixture. Alternatively, a rubber-like plug can be inserted into the opening 120 and wires can extend through small openings in the plug.

FIG. 1 depicts the bi-pin connector 10 in the unlocked configuration. The light fixture, or luminaire 20, including the bi-pin connector 10 attaches to conventional tombstones, such as the tombstone t shown in FIG. 3. The pins 24 are inserted into slots s of the tombstone in the unlocked configuration (FIG. 1), and once inserted a predetermined distance are rotated in the tombstone t to the locked configuration shown in FIG. 2. Where the bi-pin connector 10 includes wires 122 (FIG. 5) connected to the pins 24, both an electrical connection and a mechanical connection is made when the connector is inserted and rotated in the tombstone t. If desired, the luminaire 20 need not include wires in one of the bi-pin connectors (another bi-pin connector would be attached at an opposite end of the luminaire 20). The light source, such as the LEDs 22 shown in FIG. 3, can be configured to receive power via only one of the bi-pin connectors and the other bi-pin connector can be electrically isolated from the light source. The bi-pin connector not having the wires would still operate mechanically in the same manner as the bi-pin connector that included the wires, but only a mechanical connection would be made between the bi-pin connector and the tombstone t for the bi-pin connector having no wires. The bi-pin connector having no wires would most likely include the spring 72, while the bi-pin connector that included the wires may not include the spring. Where LEDs are used as the light source, since LEDs are directional it becomes more desirable to orient the LEDs in a particular direction. The bi-pin connector described herein allows for this.

A bi-pin connector has been described with reference to a particular embodiment. Modifications and alterations will occur to those upon reading and understanding the preceding description. The invention is not limited to only those embodiments disclosed herein. Instead, the invention is defined by the appended claims and the equivalents thereof.

The invention claimed is:

1. A lighting fixture comprising:

a fixture housing;

a light source disposed in the housing;

a base movably attached to an end cap, the base including at least one extension;

the end cap attached to the housing, the end cap including a connection structure configured to receive the at least one extension of the base; and a bi-pin connector attached to the base and electrically connected to the light source, the bi-pin connector including pins that rotate relative to the housing about a rotational axis interposed between the pins and are movable relative to the housing in a direction transverse to the rotational axis by the connection between the at least one extension of the base and the connection structure of end cap.

2. The lighting fixture of claim 1, wherein the bi connector further includes a bi-pin cap and a biasing element, the pins extending from the bi-pin cap in a direction parallel to the rotational axis and the biasing element urging the bi-pin cap away from the fixture housing in the direction parallel to the rotational axis.

3. The lighting fixture of claim 1, wherein the connection structure of the end cap includes at least one transverse slot that receives the at least one extension of the base.

4. The lighting fixture of claim 3, wherein the end cap further includes at least one spring clip received in the at least one transverse slot, wherein the at least one extension include detents that cooperate with the spring clips.

5. The lighting fixture of claim 1, wherein the light source is a plurality of light emitting diodes each facing in the same direction.

6. The lighting fixture of claim 1, further including an additional bi-pin connector attached to the housing, the additional bi-pin connector including pins that rotate relative to the housing about a rotational axis interposed between the pins and are movable relative to the housing in a direction transverse to the rotational axis.

7. The lighting fixture of claim 6, wherein the additional bi-pin connector is not electrically connected to the light source.

8. A bi-pin connector for a luminaire comprising:

a base configured for attachment to an end cap of an associated luminaire housing, the base including at least one extension and the end cap including a connection structure configured to receive the at least one extension of the base; and pins that rotate relative to the base about a rotational axis spaced from each pin and are movable relative to the housing in a direction perpendicular to the rotational axis via the connection between the connection structure and the at least one extension.

9. The bi-pin connector of claim 8, further comprising a bi-pin connector body, the pins extend from the bi-pin connector body in a direction parallel to the rotational axis, and the bi-pin connector body connects to the base and rotates relative to the base.

10. The bi-pin connector of claim 9, further comprising a spring, wherein the bi-pin connector body includes a bi-pin cap and a collar, the pins extend from the bi-pin cap, the base includes an opening, the collar is received in the opening in the base and the spring biases against the collar and the bi-pin cap to urge the bi-pin cap away from the base.

11. The bi-pin connector of claim 9, wherein the bi-pin connector body includes flats or a slot for engagement with an associated tool to facilitate rotating the bi-pin connector body relative to the base.

12. The bi-pin connector of claim 8, wherein the connection structure of the end cap includes at least one transverse slot and at least one spring clip received in the at least one transverse slot; and wherein the at least one extension includes detents that cooperate with the spring clips.

13. The bi-pin connector of claim 8, wherein the pins are electrically isolated and not connected to wires to supply power to an associated luminaire.

14. A luminaire comprising:

a luminaire housing;

a light source disposed in the housing;

a first bi-pin connector attached to a first base and electrically connected to the light source;

the first base movably attached to a first end cap, the first base including at least one extension;

the first end cap attached to the housing, the first end cap including a first connection structure configured to receive at least one extension of the first base;

a second bi-pin connector attached to a second base and electrically isolated from the light source;

the second base movably attached to a second end cap, the second base including at least one extension;

the second end cap attached to the housing, the second end cap including a second connection structure configured to receive at least one extension of the second base; and wherein each of the bi-pin connectors includes pins that rotate relative to the housing about a rotational axis interposed between the pins and translate in a direction perpendicular to the axis relative to the housing via the connection between the first and second connection structures and the at least one extension of the first and second base.

15. The luminaire of claim 14, wherein the first and second connection structures includes at least one transverse slot that receives the at least one extension of the first and second base.

16. The luminaire of claim 15, wherein the first and second end caps further include at least one spring clip received in the at least one transverse slots, wherein the at least one extension of the first and second base include detents that cooperate with the spring clips.

17. A light fixture comprising:

a fixture housing;

a light source disposed in the housing;

a base attached to an end cap, the base including at least one extension;

the end cap attached to the housing, the end cap including a connection structure configured to receive the at least one extension of the base; and a bi-pin connector attached to the housing and electrically connected to the light source, the bi-pin connector including pins that extend in a first direction that is parallel to an axis, wherein the pins translate in a direction perpendicular to the axis relative to the housing through the connection between the connection structure and the at least one extension.

18. The light fixture of claim 17, wherein the pins rotate relative to the housing about the axis.

19. The light fixture of claim 17, further comprising an additional bi-pin connector attached to the housing, the additional bi-pin connector being electrically isolated from the light source.

20. The light fixture of claim 17, wherein the connection structure of the end cap includes at least one transverse slot and at least one spring clip received in the at least one transverse slot; and wherein the at least one extension includes detents that cooperate with the spring clips.

* * * * *